US008981216B2

(12) United States Patent
Grant et al.

(10) Patent No.: US 8,981,216 B2
(45) Date of Patent: Mar. 17, 2015

(54) CABLE ASSEMBLY FOR COMMUNICATING SIGNALS OVER MULTIPLE CONDUCTORS

(75) Inventors: Charles Lloyd Grant, Woodstock, CT (US); Edward Young, Milford, MA (US); Andrew John Nowak, Woodstock, CT (US); Thomas Joseph Grzysiewicz, Dayville, CT (US); Paul Leo Grant, Ashford, CT (US); Kevan Tran, Webster, MA (US)

(73) Assignee: Tyco Electronics Corporation, Berwyn, PA (US)

( * ) Notice: Subject to any disclaimer, the term of this patent is extended or adjusted under 35 U.S.C. 154(b) by 747 days.

(21) Appl. No.: 12/821,798

(22) Filed: Jun. 23, 2010

(65) Prior Publication Data

US 2011/0315419 A1 Dec. 29, 2011

(51) Int. Cl.

| | |
|---|---|
| ***H01B 11/06*** | (2006.01) |
| *H01B 7/02* | (2006.01) |
| *H01B 11/00* | (2006.01) |

(52) U.S. Cl.

CPC ..... *H01B 11/06* (2013.01); *H01B 7/0216* (2013.01); *H01B 11/002* (2013.01)

USPC ..... 174/36; 174/113 R

(58) Field of Classification Search

USPC ..... 174/36, 113 R

See application file for complete search history.

(56) References Cited

U.S. PATENT DOCUMENTS

| | | | | |
|---|---|---|---|---|
| 4,707,569 | A * | 11/1987 | Yoshimura et al. | 174/116 |
| 5,015,800 | A * | 5/1991 | Vaupotic et al. | 174/34 |
| 5,283,390 | A * | 2/1994 | Hubis et al. | 174/36 |
| 5,416,268 | A | 5/1995 | Ellis | |
| 5,483,020 | A | 1/1996 | Hardie et al. | |
| 5,574,250 | A | 11/1996 | Hardie et al. | |
| 5,956,445 | A * | 9/1999 | Deitz et al. | 385/100 |
| 6,008,455 | A | 12/1999 | Lindström et al. | |
| 6,010,788 | A | 1/2000 | Kebabjian et al. | |
| 6,140,587 | A | 10/2000 | Sackett | |
| 6,169,251 | B1 | 1/2001 | Grant et al. | |
| 6,403,887 | B1 | 6/2002 | Kebabjian et al. | |
| 6,452,107 | B1 | 9/2002 | Kebabjian | |
| 6,677,518 | B2 | 1/2004 | Hirakawa et al. | |
| 6,740,808 | B1 * | 5/2004 | Chang | 174/36 |
| 6,787,694 | B1 | 9/2004 | Vexler et al. | |
| 6,803,518 | B2 | 10/2004 | Chang | |
| 6,815,611 | B1 | 11/2004 | Gareis | |
| 7,271,343 | B2 | 9/2007 | Clark | |
| 7,827,678 | B2 * | 11/2010 | Dion et al. | 29/755 |
| 8,064,174 | B2 * | 11/2011 | Williams et al. | 361/42 |
| 8,076,580 | B2 * | 12/2011 | Kolasa et al. | 174/105 R |
| 2008/0041609 | A1 * | 2/2008 | Gareis et al. | 174/113 C |

* cited by examiner

*Primary Examiner* — Chau N Nguyen

(57) ABSTRACT

A cable assembly includes elongated conductors, primary dielectric layers, a secondary dielectric layer, a conductive shield layer and a drain wire. The conductors communicate a signal. The primary dielectric layer is circumferentially disposed around each of the conductors. The secondary dielectric layer surrounds the primary dielectric layers. The conductive shield layer is disposed around the secondary dielectric layer. The drain wire is provided along an outer surface of the conductive shield layer and is electrically coupled with the conductive shield layer. The conductive shield layer communicates electromagnetic interference to an electric ground reference via the drain wire.

17 Claims, 5 Drawing Sheets

CABLE ASSEMBLY FOR COMMUNICATING SIGNALS OVER MULTIPLE CONDUCTORS

BACKGROUND OF THE INVENTION

The subject matter herein relates generally to cable assemblies and, more particularly, to cable assemblies configured to communicate data signals.

Some known cable assemblies include two or more conductors that extend along the length of the cable assembly. The conductors may be arranged in pairs and configured to communicate a differential pair signal along the length of the cable assembly. In order to reduce electromagnetic interference caused by communication of the differential pair signals along the conductors, the conductors may be twisted around one another at a twist rate. For example, the conductors may be twisted around a longitudinal axis of the cable assembly such that each conductor encircles the longitudinal axis multiple times along the length of the cable assembly. Twisting the conductors about one another may cancel out both external and internal electromagnetic interference in the conductors that is caused by an external source.

The conductors may be enclosed in insulative jackets, which are then encased in a shield. The shield may be a tape that is wound around the conductors and the jackets. The shield includes a conductive material and is electrically coupled with an electric ground reference to shield the conductors from electromagnetic interference. In some known cable assemblies, a drain wire is located within the shield along the length of the cable assembly. The drain wire is electrically joined with the shield and with the ground reference to communicate the electromagnetic interference to the ground reference. In order to shield the conductors from electromagnetic interference, typically the drain wire is carefully located between the conductors, or is aligned with the midpoint between central axes of the conductors in a direction extending perpendicular to the longitudinal axis of the cable assembly and perpendicular to the lateral distance between the central axes of the conductors. Displacing the drain wire off-center from this midpoint of the conductors may reduce the effectiveness of the drain wire and shield in shielding the conductors from electromagnetic interference.

Additionally, some known cable assemblies include a shield that is helically wound around the conductors and insulative jackets as a tape. The wrapping of the tape around the conductors and insulative jackets may result in gaps between adjacent windings of the tape. For example, the tape may not be wrapped in such a way that the tape overlaps itself as the tape is wound around the conductors and insulative jackets along the length of the cable assembly. The gaps may cause non-linear performance of the cable assemblies in the relationship between frequency domain of the signals communicated using the cable assemblies and power losses in the signals. For example, the gaps may cause significantly larger losses in one or more bands or subsets of frequencies relative to the losses incurred at other frequencies or frequency bands. Moreover, the power loss in low frequency signals communicated using some known cable assemblies may be relatively large.

Some known cable assemblies position the conductors too close to the shields of the assemblies. Positioning the conductors too close to the shield may result in electrical coupling between the conductors and shield. The coupling may cause a time skew in the signals communicated using the conductors. The time delay skew includes the difference in propagation delay along the length of the conductors between the faster and slower of the two conductors in the differential pair. An increase in the time delay skew can adversely impact the integrity of the signal.

There is still a need for a cable assembly that reduces electromagnetic interference leakage both into and out from the cable assembly.

BRIEF DESCRIPTION OF THE INVENTION

In one embodiment, a cable assembly includes elongated conductors, primary dielectric layers, a secondary dielectric layer, a conductive shield layer and a drain wire. The conductors communicate a signal. The primary dielectric layer is circumferentially disposed around each of the conductors. The secondary dielectric layer surrounds the primary dielectric layers. The conductive shield layer is disposed around the secondary dielectric layer. The drain wire is provided along an outer surface of the conductive shield layer and is electrically coupled with the conductive shield layer. The conductive shield layer communicates electromagnetic interference to an electric ground reference via the drain wire.

In another embodiment, another cable assembly is provided. The cable assembly includes elongated conductors, primary dielectric layers, a secondary dielectric layer and a conductive shield layer. The conductors communicate signals. The primary dielectric layer is circumferentially disposed around each of the conductors. The secondary dielectric layer surrounds the primary dielectric layers. The conductive shield layer is disposed around the secondary dielectric layer. The conductive shield layer includes a tube shaped sheath extending between opposite outer ends. The conductors, the primary dielectric layer, and the secondary dielectric layer are twisted around the longitudinal axis within the conductive shield layer.

DETAILED DESCRIPTION OF THE INVENTION

Figure 1:
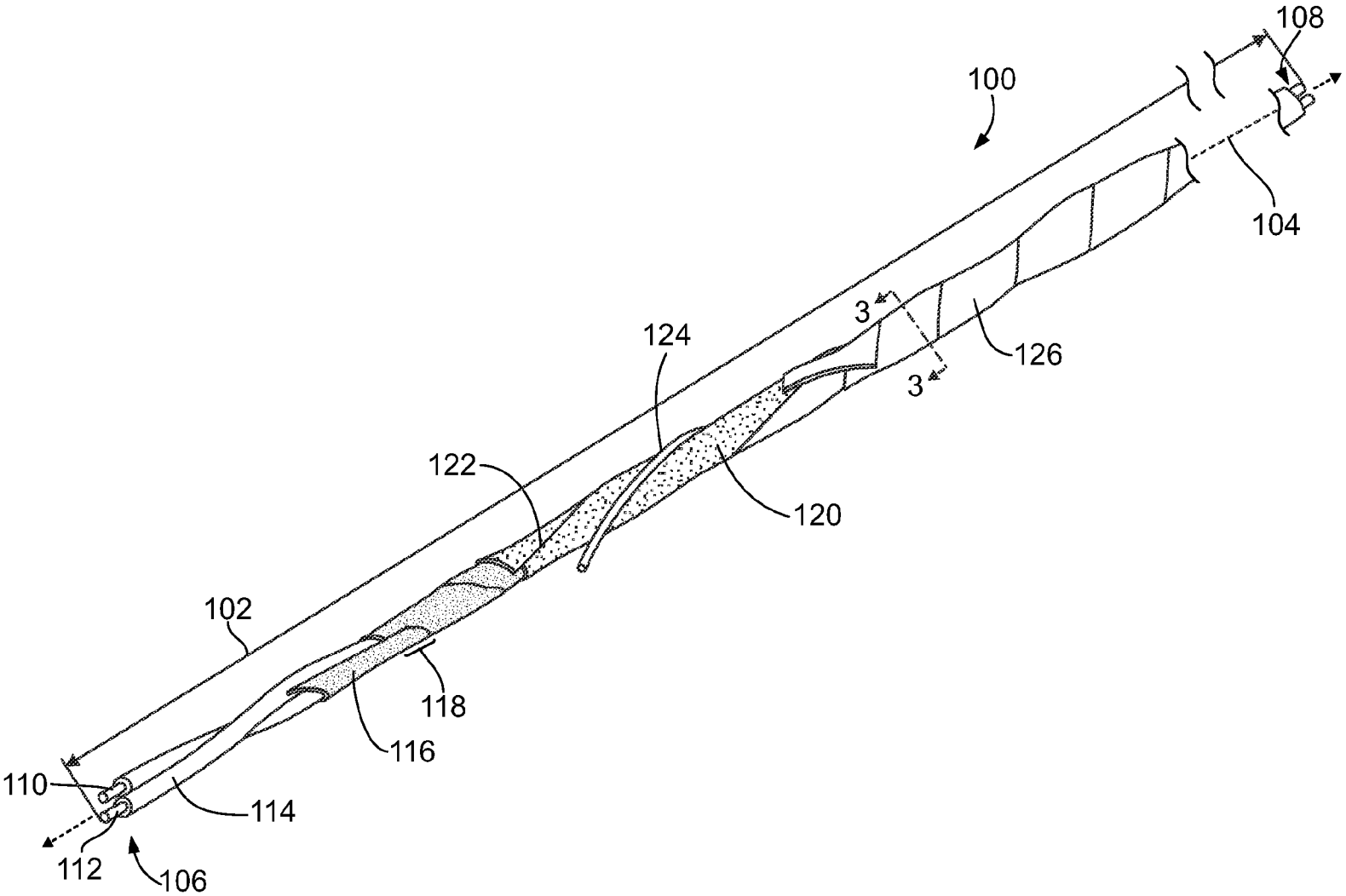
FIG. 1 is a perspective view of a cable assembly in accordance with one embodiment.

FIG. 1 is a perspective view of a cable assembly 100 in accordance with one embodiment. The cable assembly 100 is a twisted pair cable capable of communicating differential pair signals in the illustrated embodiment. The cable assembly 100 may be a cable that is multiple from other cable assemblies 100, or may be one of multiple cable assemblies 100 in a cable, or may be one of multiple similar or dissimilar cable assemblies in a cable. The cable assembly 100, which also may be referred to as a cable, is elongated along a longitudinal axis 104. The cable assembly 100 and longitudinal axis 104 may extend along linear paths as shown in FIG. 1 or may extend along a tortuous path that includes one or more bends and undulations. The cable assembly 100 extends along a length dimension 102 oriented along the longitudinal axis 104 between opposite outer ends 106, 108 of the cable assembly 100. Each of the outer ends 106, 108 may be coupled with peripheral connectors or devices (not shown) to permit the communication of signals between the connectors or devices along the cable assembly 100.

In the illustrated embodiment, the cable assembly 100 includes a pair of conductors 110, 112. The conductors 110, 112 may be elongated wires that are oriented along the longitudinal axis 104. Alternatively, the cable assembly 100 may include a greater number of conductors 110, 112. For example, the cable assembly 100 may include multiple pairs of the conductors 110, 112. The conductors 110, 112 include or are formed from conductive materials. For example, the conductors 110, 112 may include or be formed from a metal such as copper or a copper alloy. Each of the conductors 110, 112 is enclosed by a primary dielectric layer 114. For example, each conductor 110, 112 may be circumferentially surrounded by a different primary dielectric layer 114 over the length dimension 102 or a fraction of the length dimension 102. The primary dielectric layers 114 include or are formed from one or more dielectric materials. By way of example only, the primary dielectric layers 114 may be insulative jackets formed from one or more polymers such as polyethylene. The primary dielectric layers 114 may be extruded jackets that encase the conductors 110, 112. Portions of the primary dielectric layers 114 may be removed or stripped from the conductors 110, 112 at the outer ends 106, 108 to expose the conductors 110, 112.

The conductors 110, 112 and primary dielectric layers 114 are twisted around the longitudinal axis 104 at a twist rate. The twist rate represents the number of times one of the conductors 110, 112 and primary dielectric layer 114 encircles the longitudinal axis 104 per unit length. For example, the conductors 110, 112 and primary dielectric layers 114 may have a twist rate of approximately 50/meter, which means that the conductors 110, 112 and primary dielectric layers 114 are twisted around the longitudinal axis 104 fifty times per meter of length dimension 102 of the cable assembly 100. The twist rate of the conductors 110, 112 and primary dielectric layers 114 may be substantially maintained throughout the length dimension 102 of the cable assembly 100 or may vary along the length dimension 102 of the cable assembly 100. For example, the twist rate near the outer end 106 may be greater than the twist rate near the other outer end 108.

A secondary dielectric layer 116 surrounds the primary dielectric layers 114 along the length dimension 102 of the cable assembly 100. For example, the secondary dielectric layer 116 may circumferentially surround the primary dielectric layers 114 along the length dimension 102 or a fraction of the length dimension 102. A portion of the secondary dielectric layer 116 is removed from the view shown in FIG. 1 in order to more clearly illustrate the primary dielectric layers 114 and the conductors 110, 112. The secondary dielectric layer 116 alternatively may be referred to as a buffer layer. Similar to the primary dielectric layers 114, the secondary dielectric layer 116 includes or is formed from a dielectric material. For example, the secondary dielectric layer 116 may be an insulative jacket formed from one or more polymers such as polyethylene. The secondary dielectric layer 116 may be an extruded jacket that surrounds the primary dielectric layers 114 and conductors 110, 112.

In the illustrated embodiment, the secondary dielectric layer 116 is formed as a tape that is helically wound around the twisted pair of conductors 110, 112 and primary dielectric layers 114. Alternatively, the secondary dielectric layer 116 may be a tape that is helically wound around the conductors 110, 112 and primary dielectric layers 114 prior to twisting the conductors 110, 112 and primary dielectric layers 114 around one another. The secondary dielectric layer 116 may be wound around the conductors 110, 112 and primary dielectric layer 114 such that the secondary dielectric layer 116 at least partially overlaps itself with each wind around the conductors 110, 112 and primary dielectric layers 114. For example, as the secondary dielectric layer 116 is wound around the conductors 110, 112 and primary dielectric layers 114, an edge portion 118 of the secondary dielectric layer 116 may partially overlap a previously wound section of the secondary dielectric layer 116. Overlapping the secondary dielectric layer 116 onto itself may assist in sealing the conductors 110, 112 and primary dielectric layers 114 within the secondary dielectric layer 116. An adhesive may be applied to the secondary dielectric layer 116 and/or between the secondary dielectric layer 116 and the primary dielectric layers 114 to assist in securing the secondary dielectric layer 116 to the primary dielectric layers 114.

A shield 120 is disposed around the secondary dielectric layer 116. For example, the shield 120 may circumferentially enclose the secondary dielectric layer 116 along the length dimension 102 or a fraction of the length dimension 102 of the cable assembly 100. A portion of the shield 120 has been removed from the illustration shown in FIG. 1 to more clearly illustrate the secondary dielectric layer 116, the primary dielectric layers 114, and the conductors 110, 112. The shield 120 includes or is formed from a conductive material. For example, the shield 120 may include a metal film or layer, such as an aluminum (Al) layer. In another example, the shield 120 may include stacked several films or layers coupled with one another. For example, the shield 120 may include an inner layer 304 (shown in FIG. 3) that includes or is formed from a dielectric material and an outer layer 306 (shown in FIG. 3) that includes or is formed from a conductive material. One example of a dielectric inner layer 304 of the shield 120 includes Mylar®. An example of a conductive outer layer 306 includes an aluminum layer or foil. Alternatively, the shield 120 may include a conductive inner layer 304 and a dielectric outer layer 306. The shield 120 may include additional or fewer layers or films in addition to or in place of the inner and outer layers 304, 306. For example, the shield 120 may include a single conductive layer or a multilayer stack of several films.

The shield 120 is a conductive shield that shields the conductors 110, 112 from electromagnetic interference. For example, electromagnetic interference may be generated from differential pair signals communicated along the conductors 110, 112 and/or by external devices or sources. The shield 120 may be coupled with an electric ground reference to ground the electromagnetic interference and reduce or eliminate the impact of the electromagnetic interference on the integrity of the signals communicated along the cable assembly 100. For example, the shield 120 may reduce electromagnetic interference and thereby lessen the time delay skew in differential signals communicated along the conductors 110, 112.

Figure 2:
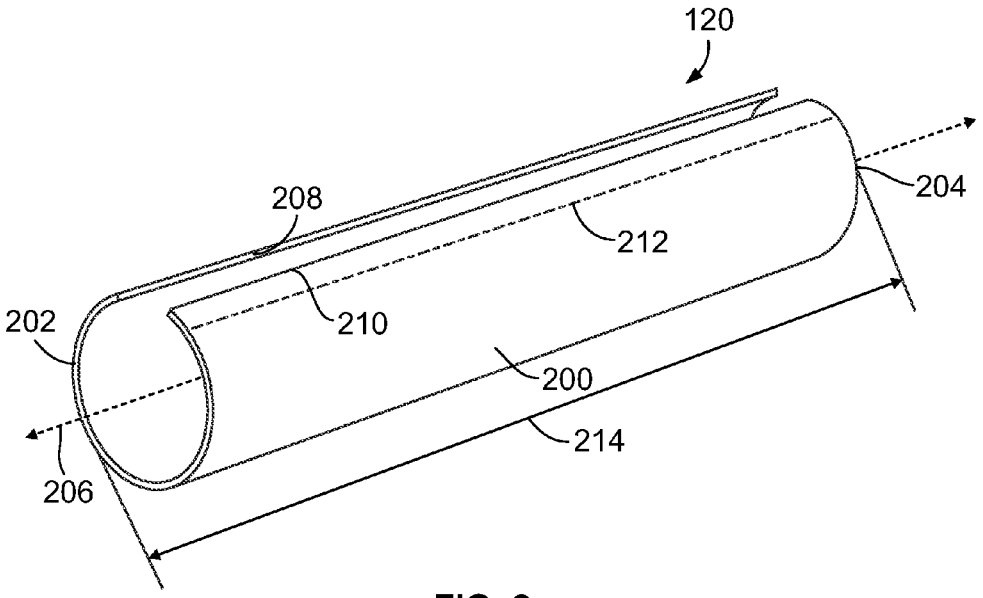
FIG. 2 illustrates a perspective view of a shield shown in FIG. 1 in accordance with one embodiment.

FIG. 2 illustrates a perspective view of the shield 120 in accordance with one embodiment. The shield 120 is shown in FIG. 2 as separate from the cable assembly 100 (shown in FIG. 1) and prior to affixing the shield 120 to the secondary dielectric layer 116 (shown in FIG. 1). The shield 120 is formed as a tube-shaped sheath in the illustrated embodiment. For example, the shield 120 may be a longitudinal tube 200 that extends from one outer end 202 to an opposite outer end 204. The tube 200 may be formed by encircling an approximately flat sheet of one or more layers (such as the inner and outer layers 304, 306 shown in FIG. 3, for example) around a longitudinal axis 206. For example, opposite edges 208, 210 of the sheet may be brought toward one another to form the tube 200. The outer ends 202, 204 are separated by a length dimension 214 measured along the longitudinal axis 206. In one embodiment, the length dimension 214 of the shield 120 is approximately the same as the length dimension 102 (shown in FIG. 1) of the cable assembly 100. Alternatively, the length dimension 214 of the shield 120 may be longer or shorter than the length dimension 102 of the cable assembly 100.

In one embodiment, the edges 208, 210 may overlap one another to form the shield 120. For example, the edge 208 may be placed adjacent to an overlap line 212 extending along the tube 200 from one outer end 202 to the other outer end 204. As shown in FIG. 2, placing the edge 208 adjacent to the overlap line 212 causes the edge 208 to at least partially overlap the edge 210. Overlapping the edges 208, 210 may enable the shield 120 to seal the conductors 110, 112 (shown in FIG. 1), the primary dielectric layers 114 (shown in FIG. 1) and the secondary dielectric layer 116 (shown in FIG. 1) within the shield 120 between the outer ends 202, 204 of the shield 120. Sealing the conductors 110, 112 within the tubular shield 120 may reduce or eliminate gaps in the shield 120 and reduce or eliminate non-linear deviations from the relationship between the frequency domain and power losses of signals communicated using the conductors 110, 112. Additionally, sealing the conductors 110, 112 within the shield 120 may reduce power loss in lower frequency signals communicated along the conductors 110, 112.

Returning to the discussion of the cable assembly 100 of FIG. 1, the edges 208, 210 (shown in FIG. 2) of the shield 120 are brought together or close to one another to form a seam 122. The seam 122 extends along the length dimension 214 (shown in FIG. 2) of the shield 120 from one outer end 202 (shown in FIG. 2) to the other outer end 204 (shown in FIG. 2). As shown in FIG. 1, the seam 122 may be formed in a helical path that repeatedly wraps around the longitudinal axis 104 of the cable assembly 100. For example, the seam 122 may encircle the secondary dielectric layer 116, the primary dielectric layers 114, and the conductors 110, 112 at a twist rate along the length dimension 102 of the cable assembly 100. The twist rate of the seam 122 is approximately the same as the twist rate of the conductors 110, 112 and primary dielectric layers 114 in one embodiment. Alternatively, the twist rate of the seam 122 differs from the twist rate of the conductors 110, 112 and the primary dielectric layers 114.

The shield 120 may be assembled in the cable assembly 100 as the conductors 110, 112, the primary dielectric layers 114, and the secondary dielectric layer 116 is twisted around the longitudinal axis 104. The conductors 110, 112, the primary dielectric layers 114, and the secondary dielectric layer 116 may be twisted around the longitudinal axis 104 within the shield 120, as shown in FIG. 1. In one embodiment, the longitudinal tube 200 (shown in FIG. 2) of the shield 120 is placed around the conductors 110, 112, the primary dielectric layers 114 and the secondary dielectric layer 116 at the same time that the conductors 110, 112, the primary dielectric layers 114 and the secondary dielectric layer 116 are twisted around the longitudinal axis 104. The shield 120 may adhere to the secondary dielectric layer 116 and become twisted around the longitudinal axis 104 at the same time that the conductors 110, 112, the primary dielectric layers 114 and the secondary dielectric layer 116 are twisted around the longitudinal axis 104. For example, an adhesive may be applied to the shield 120 to assist in securing the shield 120 to the secondary dielectric layer 116. Applying the tube-shaped shield 120 to the secondary dielectric layer 116 as the conductors 110, 112, the primary dielectric layers 114 and the secondary dielectric layer 116 are twisted may cause the shield 120 to become twisted and the seam 122 of the shield 120 to helically wind around the longitudinal axis 104. The application of the shield 120 to the secondary dielectric layer 116 and the concurrent twisting of the shield 120 and the conductors 110, 112, the primary dielectric layers 114 and the secondary dielectric layer 116 may cause the shield 120 to have improved coupling to the secondary dielectric layer 116. For example, the concurrent twisting of the shield 120, conductors 110, 112, the primary dielectric layers 114 and the secondary dielectric layer 116 may assist in preventing the shield 120 from separating from the secondary dielectric layer 116.

Alternatively, the shield 120 may be applied to the secondary dielectric layer 116 as a helically wound tape. For example, the length dimension 214 (shown in FIG. 2) of the shield 120 may be less than the length dimension 102 of the cable assembly 100 and require multiple windings of the shield 120 to enclose the secondary dielectric layer 116 within the shield 120. The shield 120 may be wound around and adhered to the secondary dielectric layer 116 as the conductors 110, 112, the primary dielectric layers 114 and the secondary dielectric layer 116 are twisted. Optionally, the shield 120 may be wound around the secondary dielectric layer 116 after the conductors 110, 112, the primary dielectric layers 114 and the secondary dielectric layer 116 are twisted.

A drain wire 124 is disposed outside of the shield 120 in the illustrated embodiment. The drain wire 124 may be helically wound around the longitudinal axis 104 along the outer layer 306 (shown in FIG. 3) of the shield 120. Alternatively, the drain wire 124 may be located between the shield 120 and the secondary dielectric layer 116. The drain wire 124 may extend along the length dimension 102 of the cable assembly 100 or over a fraction of the length dimension 102. A portion of the drain wire 124 has been removed from the illustration shown in FIG. 1 to more clearly illustrate the spatial relationships of the underlying layers and components, including the shield 120, the secondary dielectric layer 116, the primary dielectric layers 114, and the conductors 110, 112. In the illustrated embodiment, the drain wire 124 is wound around the shield 120 at a twist rate that is equivalent to, or at least approximately equivalent to, the twist rate of the conductors 110, 112. Alternatively, the drain wire 124 may be wound at a different twist rate.

The drain wire 124 includes or is formed from a conductive material, such as a metal. For example, the drain wire 124 may be wire formed from a metal or metal alloy. The drain wire 124 is electrically coupled with the shield 120 to permit communication of electromagnetic interference from the shield 120 to the drain wire 124. The drain wire 124 may be electrically joined with the shield 120 by wrapping the drain wire 124 around the shield 120 such that the drain wire 124 directly contacts the conductive outer layer 306 (shown in FIG. 3) of the shield 120. Alternatively, the drain wire 124 may be terminated to the shield 120 by soldering the drain wire 124 to the shield 120, for example.

In one embodiment, the drain wire 124 is joined to an electric ground reference. For example, the drain wire 124 may be terminated to the electric ground reference of a connector or other device (not shown) to which the cable assembly 100 is electrically coupled. The drain wire 124 may be joined to the electric ground reference at a location at or proximate to one or more of the outer ends 106, 108. Optionally, the drain wire 124 may be joined to the electric ground reference at one or more locations between the outer ends 106, 108. The drain wire 124 communicates electromagnetic interference from the shield 120 to the electric ground reference to reduce interference with signals communicated by the cable assembly 100 and/or to reduce time delay skew of differential signals communicated along the cable assembly 100.

A protective jacket 126 is provided around the shield 120 and the drain wire 124. The protective jacket 126 may enclose the shield 120 and the drain wire 124 within the protective jacket 126 along the length dimension 102 of the cable assembly 100 or along a portion of the length dimension 102. The protective jacket 126 protects the underlying components, including the drain wire 124, the shield 120, the secondary dielectric layer 116, the primary dielectric layers 114, and the conductors 110, 112 from external factors, such as environmental conditions and the like. A portion of the protective jacket 126 has been removed in the illustration shown in FIG. 1 to more clearly reveal the underlying layers and components, including the drain wire 124, the shield 120, the secondary dielectric layer 116, the primary dielectric layers 114 and the conductors 110, 112. The protective jacket 126 may include or be formed from a dielectric material. For example, the protective jacket 126 may be formed from one or more polymers such as polyesters.

In the illustrated embodiment, the protective jacket 126 is one or more tapes helically wound around the shield 120 and drain wire 124. An adhesive may be applied to the protective jacket 126 to assist in securing the protective jacket 126 to the shield 120 and drain wire 124. The protective jacket 126 may partially overlap itself as the protective jacket 126 is wound around the shield 120 and drain wire 124 in a manner similar to the secondary dielectric layer 116. For example, the protective jacket 126 may overlap itself to seal the underlying layers and components within the protective jacket 126. Alternatively, the protective jacket 126 may be extruded around the drain wire 124, the shield 120, the secondary dielectric layer 116, the primary dielectric layers 114 and the conductors 110, 112. In another embodiment, the protective jacket 126 is a longitudinal tube similar to the tube 200 (shown in FIG. 2). For example, the protective jacket 126 may be a tube that is enclosed around the drain wire 124, the shield 120, the secondary dielectric layer 116, the primary dielectric layers 114 and the conductors 110, 112 in a manner similar to as described above with respect to the tube 200.

Figure 3:
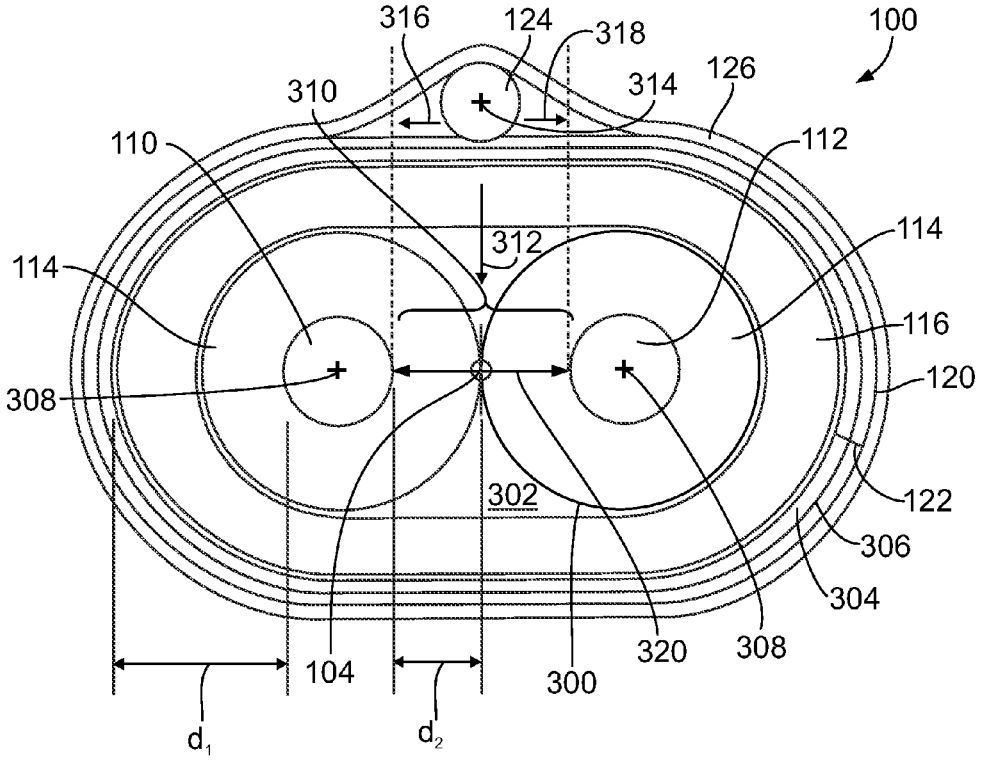
FIG. 3 is a cross-sectional view of the cable assembly shown in FIG. 1 taken along line 3-3 in FIG. 1.

FIG. 3 is a cross-sectional view of the cable assembly 100 taken along line 3-3 shown in FIG. 1 according to one embodiment. The conductors 110, 112 each include a center axis 308. The center axes 308 extend along the length of the conductors 110, 112 from one outer end 106 (shown in FIG. 1) to the opposite outer end 108 (shown in FIG. 1) of the cable assembly 100. The conductors 110, 112 are approximately centered about the center axes 308. For example, the material forming each of the conductors 110, 112 may be substantially centered about the corresponding center axis 308. The center axes 308 twist around and encircle the longitudinal axis 104 of the cable assembly 100 along the length dimension 102 (shown in FIG. 1). For example, the center axes 308 may encircle the longitudinal axis 104 along a helical path.

As shown in FIG. 3, each of the primary dielectric layers 114 circumferentially surrounds a separate conductor 110, 112. For example, the primary dielectric layers 114 surround the outside surface of the conductors 110, 112. In the illustrated embodiment, the primary dielectric layers 114 directly contact the conductors 110, 112. Alternatively, one or more gaps or voids are present between the primary dielectric layers 114 and the conductors 110, 112. The primary dielectric layers 114 may directly engage one another in a position that is at or proximate to the longitudinal axis 104 of the cable assembly 100. In another embodiment, the primary dielectric layers 114 do not contact one another.

The secondary dielectric layer 116 circumferentially surrounds the primary dielectric layers 114. For example, the secondary dielectric layer 116 encloses the primary dielectric layers 114 within the secondary dielectric layer 116. The secondary dielectric layer 116 may directly engage a portion of the outer surfaces 300 of the primary dielectric layers 114. One or more internal voids 302 may be present between the primary dielectric layers 114 and the secondary dielectric layer 116.

The shield 120 circumferentially surrounds the secondary dielectric layer 116. For example, the shield 120 encloses the secondary dielectric layer 116 around an outer perimeter of the secondary dielectric layer 116. The shield 120 may directly engage the secondary dielectric layer 116 around the outer periphery of the secondary dielectric layer 116. For example, the inner layer 304 may directly contact the secondary dielectric layer 116. Alternatively, one or more gaps or voids may be disposed between the shield 120 and the secondary dielectric layer 116. As described above, the inner layer 304 of the shield 120 may be an electrically insulative dielectric layer and the outer layer 306 may be an electrically conductive layer. The outer layer 306 is engaged by the drain wire 124 to electrically couple the shield 120 and the drain wire 124. The seam 122 of the shield 120 extends through the inner and outer layers 304, 306 in the illustrated embodiment. The protective jacket 126 circumferentially surrounds the shield 120. For example, the protective jacket 126 encloses the shield 120 around an outer perimeter of the shield 120. The protective jacket 126 also encloses the drain wire 124 between the shield 120 and the protective jacket 126.

The conductors 110, 112 are separated from one another by a separation gap 310. The separation gap 310 may be measured in an angled direction with respect to the longitudinal axis 104. For example, the separation gap 310 may be measured in a direction oriented along a lateral axis 320 that is perpendicular to the longitudinal axis 104. In one embodiment, the separation gap 310 defines the minimum separation distance between the conductors 110, 112 in a plane that intersects the cable assembly 100 and that is oriented perpendicular to the longitudinal axis 104. For example, in the cross-sectional view shown in FIG. 3, the separation gap 310 represents the minimum distance between the conductors 110, 112.

The drain wire 124 may be aligned with the separation gap 310 between the conductors 110, 112. For example, with respect to the view shown in FIG. 3, the drain wire 124 is vertically aligned with the separation gap 310. The drain wire 124 is located between the conductors 110, 112 in a vertical direction 312 that is oriented perpendicular to the longitudinal axis 104 and the lateral axis 320. The drain wire 124 may be aligned with the separation gap 310 when a center axis 314 of the drain wire 124 is located within the separation gap 310 along the vertical direction 312. The drain wire 124 and conductors 110, 112 may be twisted around the longitudinal axis 104 at approximately the same twist rate such that the drain wire 124 is aligned with the separation gap 310 throughout the length dimension 102 (shown in FIG. 1) of the cable assembly 100.

Although the drain wire 124 is shown as being centered with respect to the longitudinal axis 104 along the vertical direction 312, the drain wire 124 may be horizontally offset from the position shown in FIG. 3. For example, the drain wire 124 may be located in another position that is offset in either of lateral directions 316, 318 with respect to the illustrated position of the drain wire 124. Placing the drain wire 124 outside of the shield 120 may increase the manufacturing tolerances involved in locating the drain wire 124 with respect to the conductors 110, 112.

The conductors 110, 112 are separated from the shield 120 by a first distance $d_1$. The first distance $d_1$ may represent the minimum distance between each of the conductors 110, 112 and the shield 120. Alternatively, the first distance $d_1$ may represent the minimum distance between each of the conductors 110, 112 and the conductive layer of the shield 120. For example, if the outer layer 306 includes or is formed of a conductive material, then the first distance $d_1$ extends from each conductor 110, 112 to the outer layer 306. The conductors 110, 112 are separated from the longitudinal axis 104 by a second distance $d_2$. The second distance $d_2$ may represent the minimum distance between each of the conductors 110, 112 and the longitudinal axis 104. In the illustrated embodiment, the first and second distances $d_1$ and $d_2$ are measured in a direction oriented along the lateral axis 320. In another embodiment, the first and second distances $d_1$ and $d_2$ may be measured in a direction that is angled with respect to the lateral axis 320.

The inclusion of the secondary dielectric layer 116 may increase the first distance $d_1$ such that the first distance $d_1$ between the conductors 110, 112 and the shield 120 is greater than the second distance $d_2$ between the conductors 110, 112 and the longitudinal axis 104. Increasing the first distance $d_1$ to be greater than the second distance $d_2$ may reduce the time delay skew in differential pair signals communicated using the conductors 110, 112. Increasing the distance between the conductors 110, 112 and the shield 120 to be greater than the distance between the conductors 110, 112 and the longitudinal axis 104 also may reduce the electromagnetic interference on the signals communicated along the conductors 110, 112.

Figure 4:
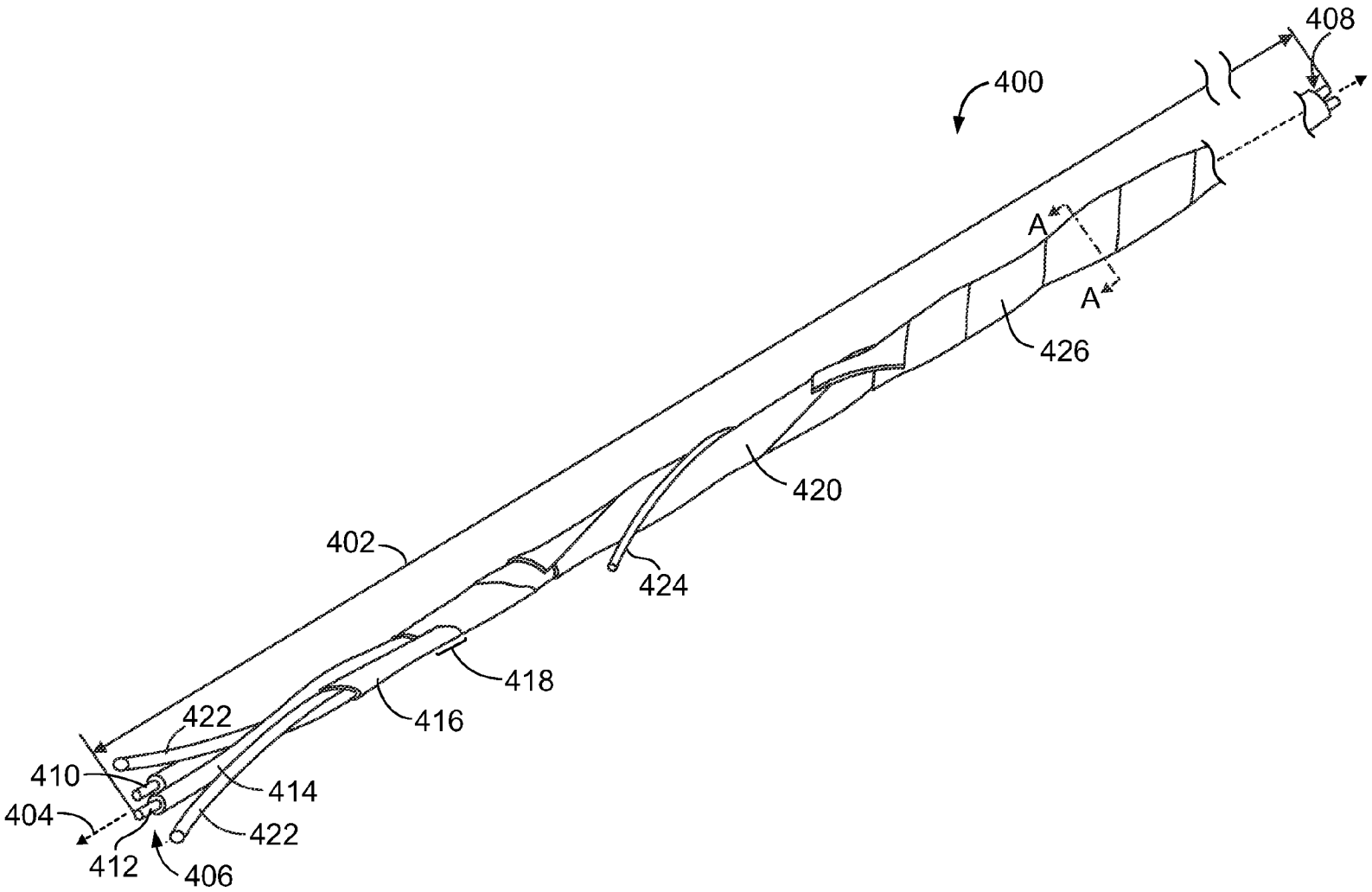
FIG. 4 is a perspective view of a cable assembly in accordance with another embodiment.

FIG. 4 is a perspective view of a cable assembly 400 in accordance with another embodiment. The cable assembly 400 is a twisted pair cable capable of communicating differential pair signals in the illustrated embodiment. The cable assembly 400 may be a cable that is multiple from other cable assemblies 400, or may be one of multiple cable assemblies 400 in a cable, or may be one of multiple similar or dissimilar cable assemblies in a cable. The cable assembly 400, which also may be referred to as a cable, is elongated along a longitudinal axis 404. The cable assembly 400 and longitudinal axis 404 may extend along linear paths as shown in FIG. 4 or may extend along a tortuous path that includes one or more bends and undulations. The cable assembly 400 extends along a length dimension 402 oriented along the longitudinal axis 404 between opposite outer ends 406, 408 of the cable assembly 400. Each of the outer ends 406, 408 may be coupled with peripheral connectors or devices (not shown) to permit the communication of signals between the connectors or devices along the cable assembly 400.

In the illustrated embodiment, the cable assembly 400 includes a pair of conductors 410, 412. The conductors 410, 412 may be elongated wires that are oriented along the longitudinal axis 404. Alternatively, the cable assembly 400 may include a greater number of conductors 410, 412. For example, the cable assembly 400 may include multiple pairs of the conductors 410, 412. The conductors 410, 412 include or are formed from conductive materials. For example, the conductors 410, 412 may include or be formed from a metal such as copper or a copper alloy. Each of the conductors 410, 412 is enclosed by a primary dielectric layer 414. For example, each conductor 410, 412 may be circumferentially surrounded by a different primary dielectric layer 414 over the length dimension 402 or a fraction of the length dimension 402. The primary dielectric layers 414 include or are formed from one or more dielectric materials. By way of example only, the primary dielectric layers 414 may be insulative jackets formed from one or more polymers such as polyethylene. The primary dielectric layers 414 may be extruded jackets that encase the conductors 410, 412. Portions of the primary dielectric layers 414 may be removed or stripped from the conductors 410, 412 at the outer ends 406, 408 to expose the conductors 410, 412, as shown in FIG. 4.

The conductors 410, 412 and primary dielectric layers 414 are twisted around the longitudinal axis 404 at a twist rate. The twist rate represents the number of times one of the conductors 410, 412 and primary dielectric layer 414 encircles the longitudinal axis 404 per unit length. For example, the conductors 410, 412 and primary dielectric layers 414 may have a twist rate of approximately 50/meter, which means that the conductors 410, 412 and primary dielectric layers 414 are twisted around the longitudinal axis 404 fifty times per meter of the length dimension 402 of the cable assembly 400. The twist rate of the conductors 410, 412 and primary dielectric layers 414 may be substantially maintained throughout the length dimension 402 of the cable assembly 400 or may vary along the length dimension 402 of the cable assembly 400. For example, the twist rate near the outer end 406 may be greater than the twist rate near the other outer end 408.

A secondary dielectric layer 416 surrounds the primary dielectric layers 414 along the length dimension 402 of the cable assembly 400. For example, the secondary dielectric layer 416 may circumferentially surround the primary dielectric layers 414 along the length dimension 402 or a fraction of the length dimension 402. A portion of the secondary dielectric layer 416 is removed from the view shown in FIG. 4 in order to more clearly illustrate the primary dielectric layers 414 and the conductors 410, 412. The secondary dielectric layer 416 alternatively may be referred to as a buffer layer. Similar to the primary dielectric layers 414, the secondary dielectric layer 416 includes or is formed from a dielectric material. For example, the secondary dielectric layer 416 may be an insulative jacket formed from one or more polymers such as polyethylene. The secondary dielectric layer 416 may be an extruded jacket that surrounds the primary dielectric layers 414 and conductors 410, 412.

In the illustrated embodiment, the secondary dielectric layer 416 is formed as a tape that is helically wound around the twisted pair of conductors 410, 412 and primary dielectric layers 414. Alternatively, the secondary dielectric layer 416 may be a tape that is helically wound around the conductors 410, 412 and primary dielectric layers 414 prior to twisting the conductors 410, 412 and primary dielectric layers 414 around one another. The secondary dielectric layer 416 may be wound around the conductors 410, 412 and primary dielectric layer 414 such that the secondary dielectric layer 416 at least partially overlaps itself with each wind around the conductors 410, 412 and primary dielectric layers 414. For example, as the secondary dielectric layer 416 is wound around the conductors 410, 412 and primary dielectric layers 414, an edge portion 418 of the secondary dielectric layer 416 may partially overlap a previously wound section of the secondary dielectric layer 416. Overlapping the secondary dielectric layer 416 onto itself may assist in sealing the conductors 410, 412 and primary dielectric layers 414 within the secondary dielectric layer 416. An adhesive may be applied to the secondary dielectric layer 416 and/or between the secondary dielectric layer 416 and the primary dielectric layers 414 to assist in securing the secondary dielectric layer 416 to the primary dielectric layers 414.

A shield 420 is disposed around the secondary dielectric layer 416. For example, the shield 420 may be adhered to the secondary dielectric layer 416 by an adhesive and circumferentially enclose the secondary dielectric layer 416 along the length dimension 402 or a fraction of the length dimension 402 of the cable assembly 400. A portion of the shield 420 has been removed from the view shown in FIG. 4. The shield 420 includes or is formed from a conductive material. For example, the shield 420 may include a metal film or layer, such as an aluminum (Al) layer. In another example, the shield 420 may include stacked several films or layers coupled with one another, similar to the shield 120 (shown in FIG. 1).

The shield 420 is a conductive shield that shields the conductors 410, 412 from electromagnetic interference. For example, electromagnetic interference may be generated from differential pair signals communicated along the conductors 410, 412 and/or by external devices or sources. The shield 420 may be coupled with an electric ground reference to ground the electromagnetic interference and reduce or eliminate the impact of the electromagnetic interference on the integrity of the signals communicated along the cable assembly 400. For example, the shield 420 may reduce electromagnetic interference and thereby lessen the time delay skew in differential signals communicated along the conductors 410, 412.

The cable assembly 100 includes elongated filler bodies 422 that are oriented along the longitudinal axis 404. Alternatively, the cable assembly 400 may include a greater number of filler bodies 422. The filler bodies 422 include or are formed from dielectric materials. For example, the filler bodies 422 may include or be formed from a polymer material. The filler bodies 422 are formed as elongated cylindrical bodies in the illustrated embodiment. The filler bodies 422 may be twisted around the longitudinal axis 404 at a twist rate that is approximately the same as or the same as the twist rate of the conductors 410, 412.

The filler bodies 422 are wound around the longitudinal axis 404 within the secondary dielectric layer 416 to provide the cable assembly 400 with a more rounded cross-sectional shape. For example, without the filler bodies 422, the cross-sectional shape of the cable assembly 400 may be an oval shape or other shape that is elongated in one direction relative to another direction. The filler bodies 422 add to the cross-sectional shape of the cable assembly 400 such that the cable assembly 400 has an approximately circular cross-sectional shape.

A drain wire 424 is disposed outside of the shield 420. The drain wire 424 may be helically wound around the longitudinal axis 404 outside of the shield 420. Alternatively, the drain wire 424 may be located between the shield 420 and the secondary dielectric layer 416. The drain wire 424 may extend along the length dimension 402 of the cable assembly 400 or over a fraction of the length dimension 402. A portion of the drain wire 424 has been removed from the view shown in FIG. 1. The drain wire 424 may be wound around the shield 420 at a twist rate that is equivalent to, or at least approximately equivalent to, the twist rate of the conductors 410, 412. Alternatively, the drain wire 424 may be wound at a different twist rate.

The drain wire 424 includes or is formed from a conductive material, such as a metal. For example, the drain wire 424 may be wire formed from a metal or metal alloy. The drain wire 424 is electrically coupled with the shield 420 to permit communication of electromagnetic interference from the shield 420 to the drain wire 424. The drain wire 424 may be electrically joined with the shield 420 by wrapping the drain wire 424 around the shield 420 such that the drain wire 424 directly contacts the shield 420. Alternatively, the drain wire 424 may be terminated to the shield 420 by soldering the drain wire 424 to the shield 420. The drain wire 424 may be joined to an electric ground reference at a location at or proximate to one or more of the outer ends 406, 408. Optionally, the drain wire 424 may be joined to the electric ground reference at one or more locations between the outer ends 406, 408. The drain wire 424 communicates electromagnetic interference from the shield 420 to the electric ground reference to reduce interference with signals communicated by the cable assembly 400 and/or to reduce time delay skew of differential signals communicated along the cable assembly 400.

A protective jacket 426 is provided around the shield 420 and the drain wire 424. The protective jacket 426 may be adhered to the shield 420 by an adhesive and enclose the shield 420 and the drain wire 424 within the protective jacket 426 along the length dimension 402 or along a portion of the length dimension 402. The protective jacket 426 protects the underlying components, including the drain wire 424, the shield 420, the secondary dielectric layer 416, the filler bodies 422, the primary dielectric layers 414, and the conductors 410, 412 from external factors, such as environmental conditions and the like. The protective jacket 426 may include or be formed from a dielectric material. For example, the protective jacket 426 may be formed from one or more polymers such as polyesters.

In the illustrated embodiment, the protective jacket 426 is a tape that is helically wound around the shield 420 and drain wire 424. The protective jacket 426 may partially overlap itself as the protective jacket 426 is wound around the shield 420 and drain wire 424 in a manner similar to the secondary dielectric layer 416. Alternatively, the protective jacket 426 may be extruded around the drain wire 424, the shield 420, the secondary dielectric layer 416, the filler bodies 422, the primary dielectric layers 414 and the conductors 410, 412. In another embodiment, the protective jacket 426 is a longitudinal tube similar to the tube 200 (shown in FIG. 2).

The circular cross-sectional shape of the cable assembly 400 that is provided by the filler bodies 422 may assist in securing the secondary dielectric layer 416 to the filler bodies 422 and the primary dielectric layers 414, the shield 420 to the secondary dielectric layer 416, and/or the protective jacket 426 to the shield 420. The secondary dielectric layer 416 may be coupled to the filler bodies 422 and the primary dielectric layers 414 by winding or wrapping the secondary dielectric layer 416 around the filler bodies 422 and the primary dielectric layers 414. The filler bodies 422 and primary dielectric layers 414 provide support to the secondary dielectric layer 416 in directions that are obliquely or transversely oriented with respect to each other. The filler bodies 422 and the primary dielectric layers 414 may make the cross-sectional area of the cable assembly 400 more circular than a cable assembly that does not include the filler bodies 422. As the cross-sectional area of a cable assembly becomes less circular, adhesion between abutting components in the cable assembly may be decreased and result in the components separating from each other. For example, if the cable assembly 400 had a less circular cross-sectional shape, then the secondary dielectric layer 416 may separate from the primary dielectric layers 414 and the filler bodies 422, the shield 420 may separate from the secondary dielectric layer 416, and/or the protective jacket 426 may separate from the shield 420.

Figure 5:
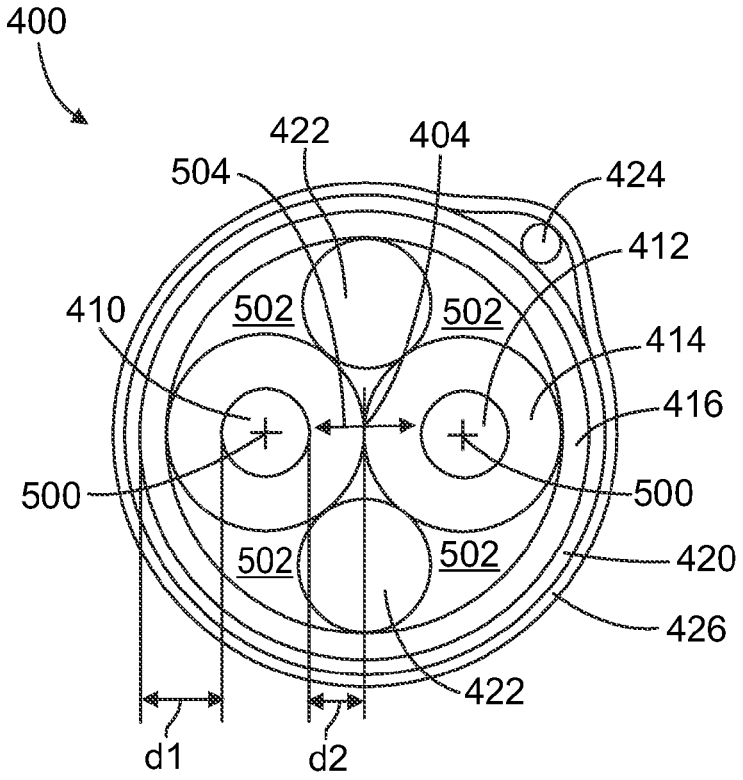
FIG. 5 is a cross-sectional view of the cable assembly shown in FIG. 4 along line A-A in FIG. 4 according to one embodiment.

FIG. 5 is a cross-sectional view of the cable assembly 400 along line A-A shown in FIG. 4 according to one embodiment. The conductors 410, 412 each include a center axis 500. The center axes 500 extend along the length of the conductors 410, 412 from one outer end 406 (shown in FIG. 4) to the opposite outer end 408 (shown in FIG. 4) of the cable assembly 400. The conductors 410, 412 are approximately centered about the center axes 500. For example, the material forming each of the conductors 410, 412 may be substantially centered about the corresponding center axis 500. The center axes 500 twist around and encircle the longitudinal axis 404 of the cable assembly 400 along the length dimension 402 (shown in FIG. 4). For example, the center axes 500 may encircle the longitudinal axis 404 along a helical path.

As shown in FIG. 5, each of the primary dielectric layers 414 circumferentially surrounds a separate conductor 410, 412. For example, the primary dielectric layers 414 surround the outside surface of the conductors 410, 412. In the illustrated embodiment, the primary dielectric layers 414 directly contact the conductors 410, 412. Alternatively, one or more gaps or voids are present between the primary dielectric layers 414 and the conductors 410, 412. The primary dielectric layers 414 may directly engage one another in a position that is at or proximate to the longitudinal axis 404 of the cable assembly 400. In another embodiment, the primary dielectric layers 414 do not contact one another.

The secondary dielectric layer 416 circumferentially surrounds the primary dielectric layers 414. For example, the secondary dielectric layer 416 may enclose the primary dielectric layers 414 within the secondary dielectric layer 416. The secondary dielectric layer 416 may directly the primary dielectric layers 414. One or more internal voids 502 may be present between the secondary dielectric layer 416 and the primary dielectric layers 414 and filler bodies 422. In the illustrated embodiment, there are four internal voids 502 in the cable assembly 400, with each void 502 being bounded by the secondary dielectric layer 416, the primary dielectric layer 414 of one of the conductors 410, 412, and one of the filler bodies 422. Alternatively, a different number of voids 502 may be present and/or bounded by different components of the cable assembly 400.

As shown in FIG. 5, the filler bodies 422 are positioned to provide an approximate circular cross-sectional shape of the cable assembly 400. Each filler body 422 may directly engage the primary dielectric layers 414 of the conductors 410, 412 while being separated from the other filler body 422. The filler bodies 422 shown in FIG. 5 engage the secondary dielectric layer 416 and the primary dielectric layers 414 of both conductors 410, 412.

The shield 420 circumferentially surrounds the secondary dielectric layer 416. For example, the shield 420 encloses the secondary dielectric layer 416 around an outer perimeter of the secondary dielectric layer 416. The shield 420 may directly engage the secondary dielectric layer 416 around the outer periphery of the secondary dielectric layer 416. Alternatively, one or more gaps or voids may be disposed between the shield 420 and the secondary dielectric layer 416. The drain wire 424 is disposed between the shield 420 and the protective jacket 426. The protective jacket 426 extends around the shield 420 and the drain wire 424 to enclose the drain wire 424 and shield 420 within the protective jacket 426.

The conductors 410, 412 are separated from one another by a separation gap 504. The separation gap 504 may be measured in an angled direction with respect to the longitudinal axis 404. For example, the separation gap 504 may be measured in a direction that is perpendicular to the longitudinal axis 404. In one embodiment, the separation gap 504 defines the minimum separation distance between the conductors 410, 412 in a plane that intersects the cable assembly 400 and that is oriented perpendicular to the longitudinal axis 404. For example, in the cross-sectional view shown in FIG. 5, the separation gap 504 represents the minimum distance between the conductors 410, 412.

The conductors 410, 412 are separated from the shield 420 by a first distance $d_1$. The first distance $d_1$ may represent the minimum distance between each of the conductors 410, 412 and the shield 420. Alternatively, the first distance $d_1$ may represent the minimum distance between each of the conductors 410, 412 and a conductive layer of the shield 420. For example, if the shield 420 includes multiple layers, the first distance $d_1$ may be measured between each conductor 410, 412 and the conductive layer of the shield 420. The conductors 410, 412 are separated from the longitudinal axis 404 by a second distance $d_2$. The second distance $d_2$ may represent the minimum distance between each of the conductors 410, 412 and the longitudinal axis 404. In the illustrated embodiment, the first and second distances $d_1$ and $d_2$ are measured in a direction oriented perpendicular to the longitudinal axis 404.

Similar to the cable assembly 100 (shown in FIG. 1), the inclusion of the secondary dielectric layer 416 may increase the first distance $d_1$ such that the first distance $d_1$ between the conductors 410, 412 and the shield 420 is greater than the second distance $d_2$ between the conductors 410, 412 and the longitudinal axis 404. Increasing the distance between the conductors 410, 412 and the shield 420 to be greater than the distance between the conductors 410, 412 and the longitudinal axis 404 may reduce or eliminate the time skew imparted on signals communicated using the conductors 410, 412 that may otherwise be imparted if the first distance $d_1$ were not greater than the second distance $d_2$ in one embodiment.

Figure 6:
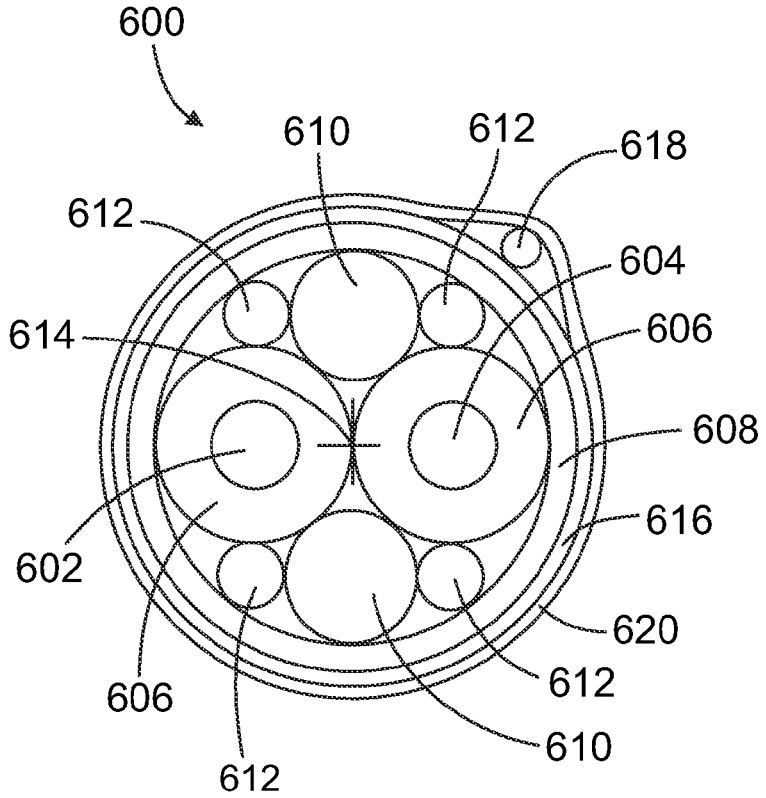
FIG. 6 is a cross-sectional view of a cable assembly in accordance with another embodiment.

FIG. 6 is a cross-sectional view of a cable assembly 600 in accordance with another embodiment. The cable assembly 600 may be similar to the cable assembly 400 shown in FIG. 4. The cable assembly 600 may be a cable that is multiple from other cable assemblies 600, or may be one of multiple cable assemblies 600 in a cable, or may be one of multiple similar or dissimilar cable assemblies in a cable. The view shown in FIG. 6 may be a cross-sectional view taken along a similar line as the cross-sectional view of the cable assembly 400 that is shown in FIG. 5.

Similar to the cable assembly 400 (shown in FIG. 4), the cable assembly 600 includes conductors 602, 604 enclosed in primary dielectric layers 606. The conductors 602, 604 may be similar or identical to the conductors 410, 412 (shown in FIG. 4). The primary dielectric layer 606 may be similar or identical to the primary dielectric layer 414 (shown in FIG. 4). A secondary dielectric layer 608 encloses the primary dielectric layers 606 and conductors 602, 604. The secondary dielectric layer 608 may be similar or identical to the secondary dielectric layer 416 (shown in FIG. 4).

Elongated filler bodies 610 and interstitial elongated filler bodies 612 are positioned within the secondary dielectric layer 608 between the primary dielectric layers 606 and the secondary dielectric layer 608. The filler bodies 610 may be similar or identical to the filler bodies 422 (shown in FIG. 4). The interstitial filler bodies 612 are elongated dielectric bodies that are positioned within the secondary dielectric layer 608 between the filler bodies 610, the primary dielectric layers 606, and the secondary dielectric layer 608. For example, the interstitial filler bodies 612 may be positioned in the voids 502 (shown in FIG. 5) of the cable assembly 400 (shown in FIG. 4). In the illustrated embodiment, the interstitial filler bodies 612 are located in volumes of the cable assembly 600 that are bounded by the secondary dielectric layer 608, the primary dielectric layers 606, and the filler bodies 610. Each of the interstitial filler bodies 612 may engage one of the primary dielectric layers 606, one of the filler bodies 610, and the secondary dielectric layer 608. The interstitial filler bodies 612, filler bodies 610, primary dielectric layers 606, and conductors 602, 604 may be helically wound around a longitudinal axis 614 of the cable assembly 600 in a manner that is similar to the winding of the conductors 410, 412 (shown in FIG. 4), primary dielectric layers 414 (shown in FIG. 4), and filler bodies 422 around the longitudinal axis 404 (shown in FIG. 4) of the cable assembly 400 (shown in FIG. 4)

The interstitial filler bodies 612 provide additional support to the secondary dielectric layer 608 to ensure that the cross-sectional shape of the cable assembly 600 is more circular than non-circular. For example, the interstitial filler bodies 612 are placed to fill the voids 502 (shown in FIG. 5) of the cable assembly 400 (shown in FIG. 4) to prevent the secondary dielectric layer 608 from inwardly sagging between the filler bodies 610 and the primary dielectric layers 606.

A shield 616 is located around the secondary dielectric layer 608. The shield 616 may be similar or identical to the shield 420 (shown in FIG. 4). A drain wire 618 is wound around the outside of the shield 616. The drain wire 618 may be similar or identical to the drain wire 424 (shown in FIG. 4). A protective jacket 620 is wrapped around the outside of the shield 616 and the drain wire 618. The protective jacket 620 may be similar or identical to the protective jacket 426 (shown in FIG. 4). The protective jacket 620 encloses the drain wire 618 between the shield 616 and the protective jacket 620.

Figure 7:
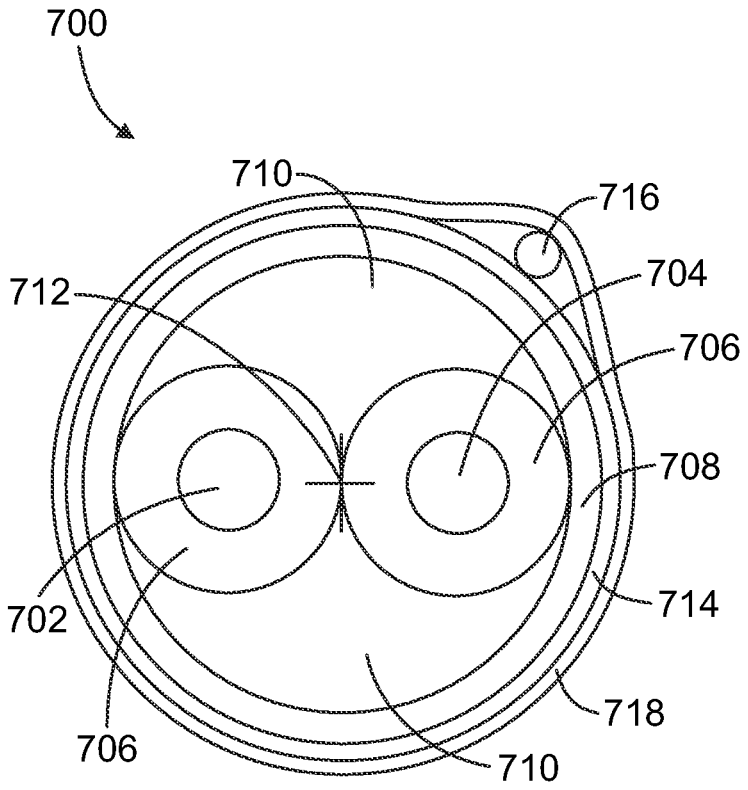
FIG. 7 is a cross-sectional view of a cable assembly in accordance with another embodiment.

FIG. 7 is a cross-sectional view of a cable assembly 700 in accordance with another embodiment. The cable assembly 700 may be similar to the cable assembly 100 shown in FIG. 1. The cable assembly 700 may be a cable that is multiple from other cable assemblies 700, or may be one of multiple cable assemblies 700 in a cable, or may be one of multiple similar or dissimilar cable assemblies in a cable. The view shown in FIG. 7 may be a cross-sectional view taken along a similar line as the cross-sectional view of the cable assembly 100 that is shown in FIG. 5.

Similar to the cable assembly 100 (shown in FIG. 1), the cable assembly 700 includes conductors 702, 704 enclosed in primary dielectric layers 706. The conductors 702, 704 may be similar or identical to the conductors 110, 112 (shown in FIG. 1). The primary dielectric layers 706 may be similar or identical to the primary dielectric layers 114 (shown in FIG. 1). A secondary dielectric layer 708 encloses the primary dielectric layers 706 and conductors 702, 704. The secondary dielectric layer 708 may be similar or identical to the secondary dielectric layer 116 (shown in FIG. 1).

Elongated filler bodies 710 are positioned within the secondary dielectric layer 708 between the primary dielectric layers 706 and the secondary dielectric layer 708. The filler bodies 710 substantially fill in the voids between the primary dielectric layers 706 and the secondary dielectric layer 708. For example, in comparison to the cable assembly 100 (shown in FIG. 1), the filler bodies 710 may fill in all or substantially all of the voids 302 (shown in FIG. 3) to provide the cable assembly 700. The filler bodies 710 include or are formed from a dielectric material. The filler bodies 710 may be provided as relatively thin fibers that are helically wrapped around a longitudinal axis 712 of the cable assembly 700. For example, the filler bodies 710 may be relatively thin strings or yarns that are helically wrapped around the longitudinal axis 712 with the conductors 702, 704 and primary dielectric layers 706. Alternatively, the filler bodies 710 may be molded bodies that are formed around the primary dielectric layers 706. For example, the filler bodies 710 may be polymers that are extruded around the primary dielectric layers 706.

The filler bodies 710 provide the cable assembly 700 with a circular cross-sectional shape. A shield 714 is wrapped around the filler bodies 710. The shield 714 may be similar or identical to the shield 120 (shown in FIG. 1) of the cable assembly 100 (shown in FIG. 1). A drain wire 716 is wrapped around the outside of the shield 714. The drain wire 716 may be similar or identical to the drain wire 124 (shown in FIG. 1). A protective jacket 718 is wrapped around the outside of the shield 714 and the drain wire 716. The protective jacket 718 may be similar or identical to the protective jacket 126 (shown in FIG. 1) of the cable assembly 100. The protective jacket 718 is wrapped around the outside of the drain wire 716 and the shield 714 such that the drain wire 716 is enclosed between the protective jacket 718 and the shield 714.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosed subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cable assembly comprising:

elongated conductors configured to communicate a signal;

a primary dielectric layer circumferentially disposed around each of the conductors;

a secondary dielectric layer surrounding the primary dielectric layers;

a conductive shield layer disposed around the secondary dielectric layer; and a drain wire provided outside of the conductive shield layer and electrically coupled with the conductive shield layer, wherein the conductive shield layer is configured to communicate electromagnetic interference to an electric ground reference via the drain wire; and a protective jacket that surrounds and encloses the drain wire and the conductive shield layer, the jacket directly engaging the drain wire and the conductive shield layer and holding the drain wire against the conductive shield layer;

wherein the elongated conductors and the primary dielectric layers form insulated conductors, the secondary dielectric layer defining a channel that is dimensioned such that only a single pair of said insulated conductors is capable of being located within the channel, the insulated conductors of said single pair being twisted about each other within the conductive shield layer; and wherein the conductive shield layer has opposite longitudinal edges and opposite end edges, the longitudinal edges extending along a length of the conductive shield layer between the end edges, the end edges extending along a width of the conductive shield layer between the longitudinal edges, the conductive shield layer being disposed around the secondary dielectric layer to form a tube shaped sheath, wherein each of the end edges encircles the secondary dielectric layer when the sheath is formed and the longitudinal edges are coupled to each other to define a seam when the sheath is formed, wherein the elongated conductors, the primary dielectric layers, the secondary dielectric layer, and the sheath are twisted around a central longitudinal axis of the cable assembly so that the seam extends along a path that helically wraps around the longitudinal axis.

2. The cable assembly of claim 1, wherein the conductors are separated from one another by a separation gap in a direction that is angled with respect to a central longitudinal axis that extends along the cable assembly, further wherein the drain wire is aligned with the separation gap along a vertical direction oriented perpendicular to the longitudinal axis.

3. The cable assembly of claim 1, wherein the cable assembly extends along a central longitudinal axis, each of the conductors being separated from the conductive shield layer by a first distance and from the longitudinal axis by a smaller second distance, wherein the first distance is at least twice the second distance.

4. The cable assembly of claim 1, wherein the conductive shield layer comprises a tube shaped sheath extending along a length of the conductors.

5. The cable assembly of claim 1, further comprising elongated dielectric filler bodies disposed between the primary dielectric layers and the secondary dielectric layer, the filler bodies filling voids bounded by the primary dielectric layers and the secondary dielectric layer.

6. The cable assembly of claim 5, wherein at least one of the filler bodies directly engages two of said primary dielectric layers and also directly engages the secondary dielectric layer.

7. The cable assembly of claim 5, wherein the filler bodies are first filler bodies, further comprising second elongated dielectric filler bodies disposed between the first filler bodies, the primary electric layers, and the secondary dielectric layer, wherein the first and second filler bodies have different cross-sectional dimensions.

8. The cable assembly of claim 1, wherein at least one of a void or a filler body is located between the insulated conductors of the pair.

9. A cable assembly comprising:

elongated conductors configured to communicate a signal;

a primary dielectric layer circumferentially disposed around each of the conductors;

a secondary dielectric layer surrounding the primary dielectric layers;

a conductive shield layer disposed around the secondary dielectric layer; and a drain wire provided outside of the conductive shield layer and electrically coupled with the conductive shield layer, wherein the conductive shield layer is configured to communicate electromagnetic interference to an electric ground reference via the drain wire, wherein the conductive shield layer comprises a tube shaped sheath extending along a length of the conductors, and wherein the conductive shield layer is twisted around the longitudinal axis after being disposed around the conductors, the primary dielectric layers, and the secondary dielectric layer.

10. A cable assembly that extends along a central longitudinal axis, the cable assembly comprising:

insulated conductors, each insulated conductor having an elongated conductor configured to communicate a signal and a primary dielectric layer that surrounds the corresponding conductor;

a secondary dielectric layer surrounding the insulated conductors and the longitudinal axis;

a conductive shield layer having opposite longitudinal edges and opposite end edges, the longitudinal edges extending along a length of the conductive shield layer between the end edges, the end edges extending along a width of the conductive shield layer between the longitudinal edges, the conductive shield layer being disposed around the secondary dielectric layer to form a tube shaped sheath, wherein each of the end edges encircles the longitudinal axis and the secondary dielectric layer when the sheath is formed, the longitudinal edges being coupled to each other to define a seam when the sheath is formed, wherein the insulated conductors, the secondary dielectric layer, and the sheath are twisted around the longitudinal axis so that the seam extends along a path that helically wraps around the longitudinal axis.

11. The cable assembly of claim 10, further comprising a drain wire provided along an outer surface of the conductive shield layer and configured to electrically couple the conductive shield layer with an electric ground reference, the conductive shield layer conveying electromagnetic interference to the electric ground reference via the drain wire.

12. The cable assembly of claim 11, wherein the conductors are separated from one another by a separation gap in an angled direction with respect to the longitudinal axis, the drain wire aligned with the separation gap along a vertical direction that is oriented perpendicular to the longitudinal axis and the angled direction.

13. The cable assembly of claim 10, wherein each of the conductors is separated from the conductive shield layer by a first distance along an angled direction with respect to the longitudinal axis and each of the conductors is separated from the longitudinal axis by a smaller second distance.

14. The cable assembly of claim 10, wherein the conductors and the seam of the conductive shield layer are twisted about the longitudinal axis at approximately equivalent twist rates.

15. The cable assembly of claim 10, further comprising elongated dielectric filler bodies disposed between the primary dielectric layers and the secondary dielectric layer, the filler bodies filling voids bounded by the primary dielectric layers and the secondary dielectric layer.

16. The cable assembly of claim 15, wherein the filler bodies are first filler bodies, further comprising second elongated dielectric filler bodies disposed between the first filler bodies, the primary dielectric layers, and the secondary dielectric layer.

17. The cable assembly of claim 10, wherein the longitudinal edges include first and second longitudinal edges, the first longitudinal edge overlapping the second longitudinal edge, the first longitudinal edge defining the seam.

* * * * *